US005737881A

United States Patent [19]

Stocksieker

[11] Patent Number: 5,737,881

[45] Date of Patent: Apr. 14, 1998

[54] INTERLOCKING ROOF SYSTEM

[76] Inventor: Richard Stocksieker, Dingle Hill Rd., Andes, N.Y. 13731

[21] Appl. No.: 764,940

[22] Filed: Dec. 13, 1996

[51] Int. Cl.[6] ..... E04B 7/00

[52] U.S. Cl. ..... 52/90.1; 52/539; 52/540; 52/545; 52/547; 52/519; 52/478; 52/469; 52/470; 52/460; 52/462

[58] Field of Search ..... 52/90.1, 518, 519, 52/539–542, 545–547, 462, 460, 465, 469, 470, 478

[56] References Cited

U.S. PATENT DOCUMENTS

| | | | |
|---|---|---|---|
| 1,861,998 | 3/1932 | Bennet | 52/542 |
| 2,160,642 | 5/1939 | Bumpas et al. | 52/542 X |
| 2,264,546 | 12/1941 | Ochs | 52/539 X |
| 2,682,236 | 6/1954 | Holmstrom et al. | 52/518 X |
| 2,697,407 | 12/1954 | Tyree | 52/478 X |
| 3,110,130 | 11/1963 | Trachtenberg | 52/545 |
| 3,703,062 | 11/1972 | McKinney | 52/545 |
| 4,120,132 | 10/1978 | Kendrick | 52/478 |
| 4,139,974 | 2/1979 | Fox | 52/519 X |

*Primary Examiner*—Robert Canfield

[57] ABSTRACT

An interlocking roof system of tiers of successively higher interlocking panels mounted on base members, each panel being held in place by protrusions fitted into notches in the base member of the next higher tier, the panels of each higher tier having a groove wrapped about and locked onto a lip of the adjacent lower panel, side lips and clips being used to connect adjacent panels located in the same horizontal tier. The base member of the lowest tier is mounted at its lowest edge on a riser along the lowest edge of the roof being covered and at its upper edge on the rafters of the roof being covered. The next lowest base member is located at its lowest edge along the upper edge of the adjacent lower base member and at its upper edge on the rafters.

6 Claims, 5 Drawing Sheets

INTERLOCKING ROOF SYSTEM

BACKGROUND OF THE INVENTION

This invention relates to roofs and more particularly to an interlocking roof system with preformed metal panels which are held on the roof without the need for nails or similar fasteners but rather by locking the panels into the base members onto which the panels are mounted and interlocking the panels both side to side and one above the other while creating an attractive roof which can be installed without the need for skilled sheet metal workers.

A wide variety of roof coverings exist. Shingle roofs formed from many types of materials are well known. Shingles which vertically overlap one another with alternating vertical seams have been known for generations and can be made from a wide variety of materials including wood, slate or composition. Metal roofs are also well known, but usually require considerable skill to install. Holding any covering on a roof poses a problem and the use of even one exposed nail soon results in leaks. Wind, particularly with a sloping roof, poses problems and most often with a composition roof can cause rain to be driven up under the shingles resulting in leaks.

There is a need for a roof, particularly a metal roof, which can be installed without nails and which can be installed without soldering or the need for skilled labor.

It is an object of the present invention to provide a secure roof that can be easily installed It is a further object of the present invention to provide a roof that can be installed without exposed fasteners.

It is a further object of the present invention to provide a roof which is economical.

It is a further object of the present invention to provide a roof which has a long life.

SUMMARY OF THE INVENTION

In accordance with this invention, a panel is used with the lower edge wrapped under itself to from a groove, Above the groove a flat area is located which turns upwardly at substantially right angles at the upper edge and then turns back over the flat area before turning upwardly again and then again turning back again over the flat area to form an upper lip which fits into the groove of the next higher panel. At the side edges, a side member is formed at substantially right angles to the flat area and then turns again substantially at right angles over the flat area to form side lips. If multiple panels are used in any one tier of the roof, the multiple horizontal panels are connected by a clip joiner which has two opposing grooves into which the lips are held. Each panel is fitted over base members which overlap one another, each successive higher base member rests at its lower edge on the upper edge of the base member of the adjacent lower tier. The lower edge of each base member is indented or notched along the lower edge. The protrusion of each panel is fitted into the notch of the next base member of the next higher tier which secures the panels to the base members and thus the panels to the structure forming a roof without any nailing of other fastening whatsoever to the panels.

DETAILED DESCRIPTION OF THE DRAWINGS

Figure 2:
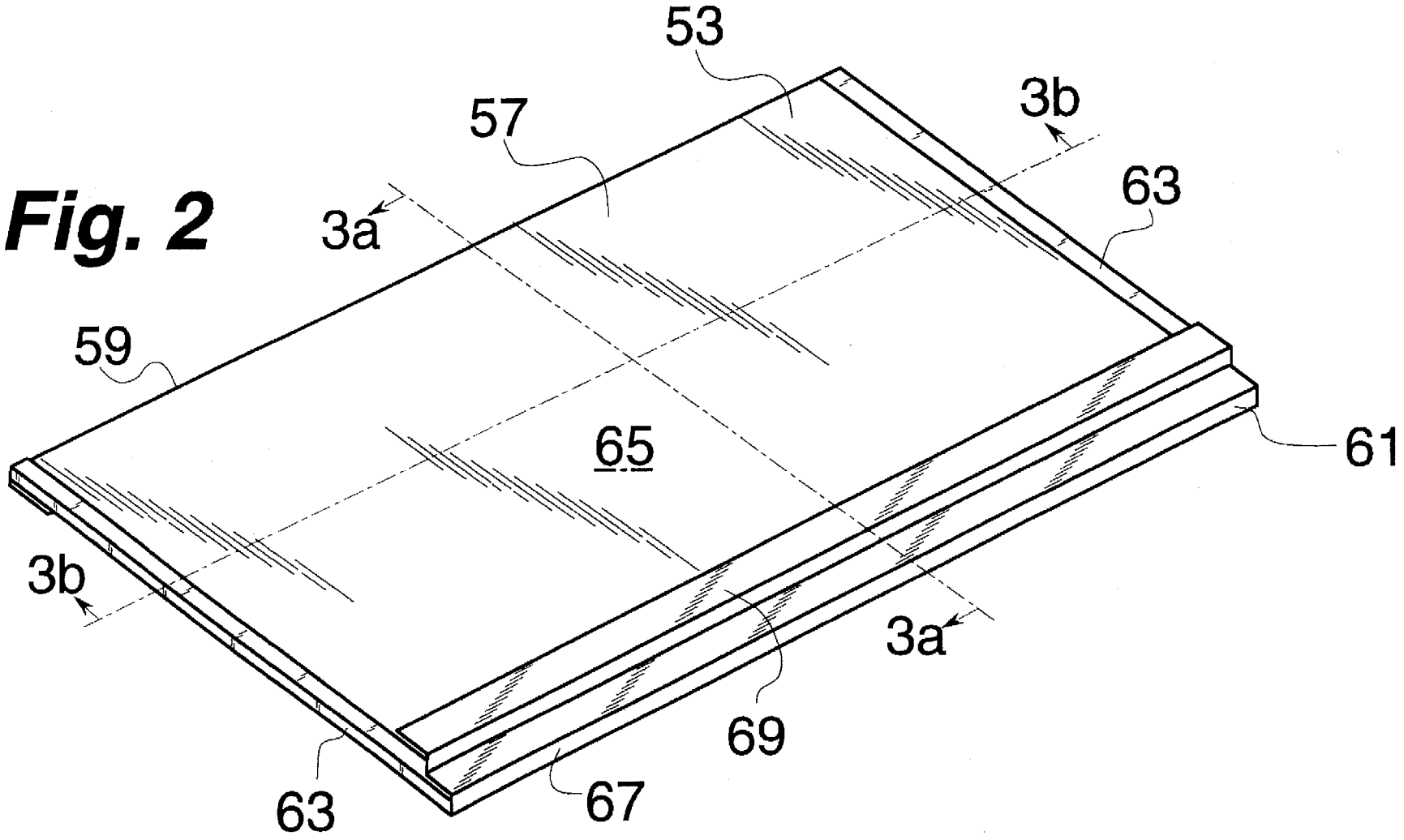
FIG. 2 is a perspective view of a panel showing the protrusion at the upper edge of the panels and the side lips for connecting adjoining horizontal panels.
Figure 3B:
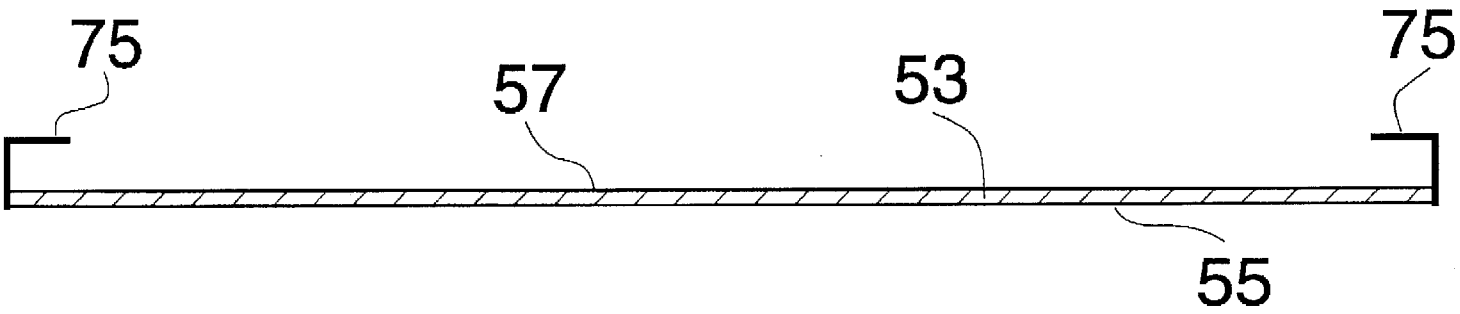
Figure 3A:
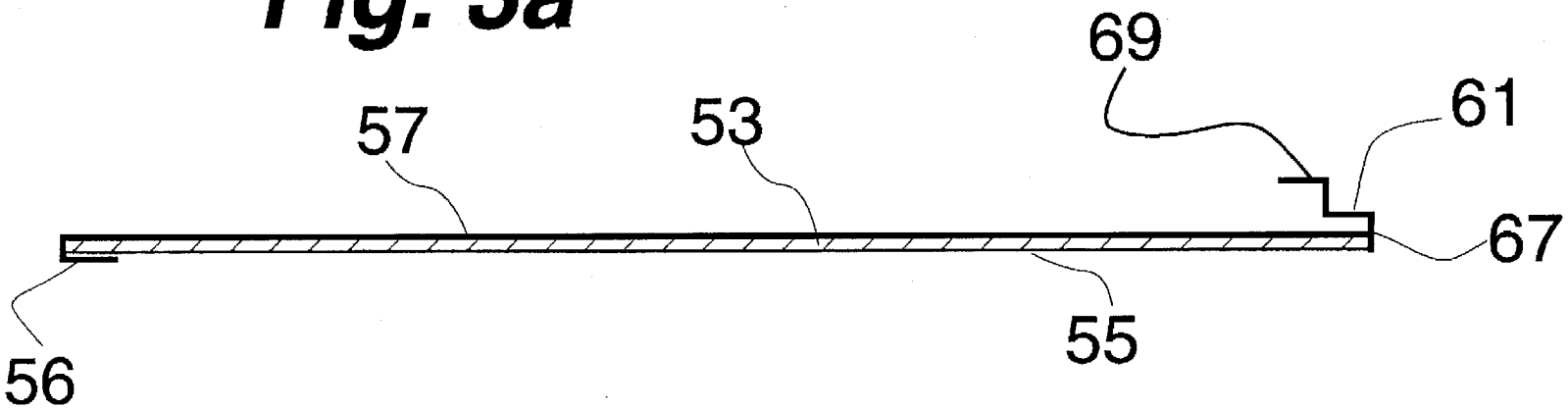

FIG. 3*a* is a cross-sectional view taken along line 3*a*–3*a* of FIG. 2.

FIG. 3*b* is a cross-sectional view taken along line 3*b*–3*b* of FIG. 2.

Figure 4A:
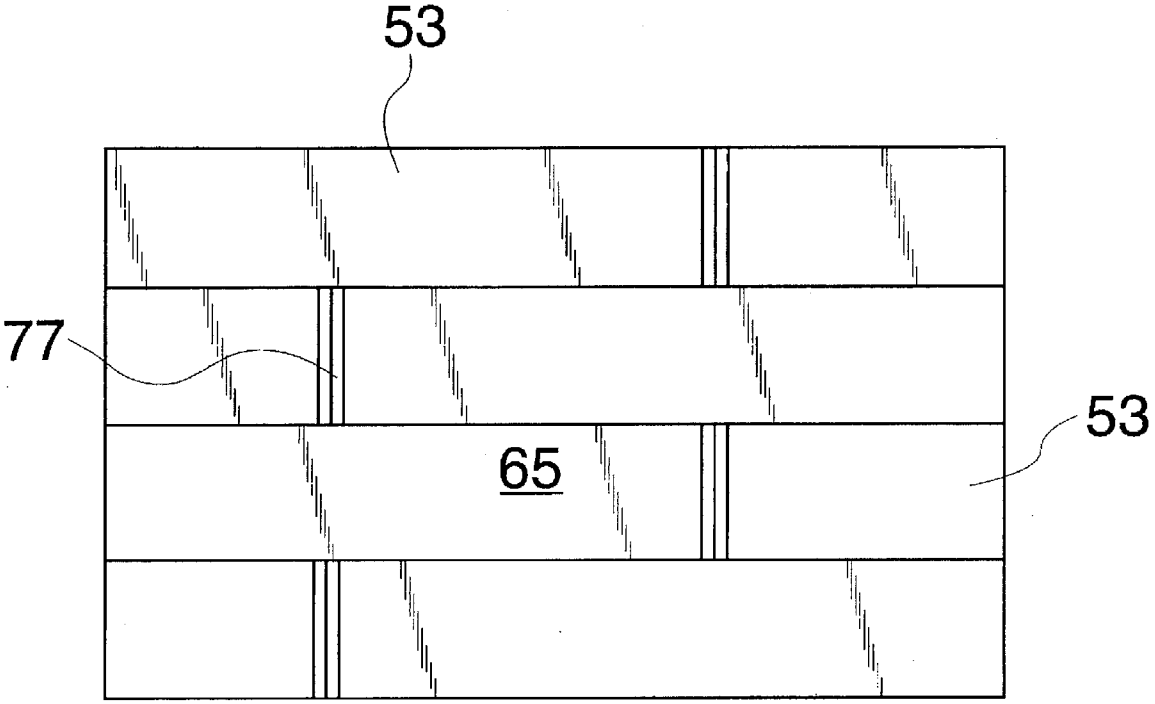

FIG. 4*a* is a plan view of a roof utilizing the panels and showing the clip joiner between adjacent horizontal panels.

Figure 4B:
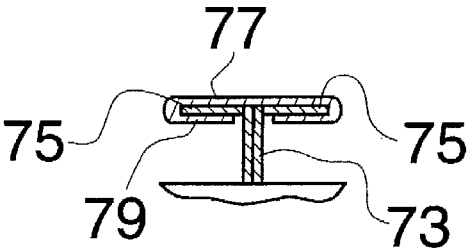

FIG. 4*b* is a cross-sectional view of two adjoining edges of two adjoining panels with the clip joiner in place.

Figure 1:
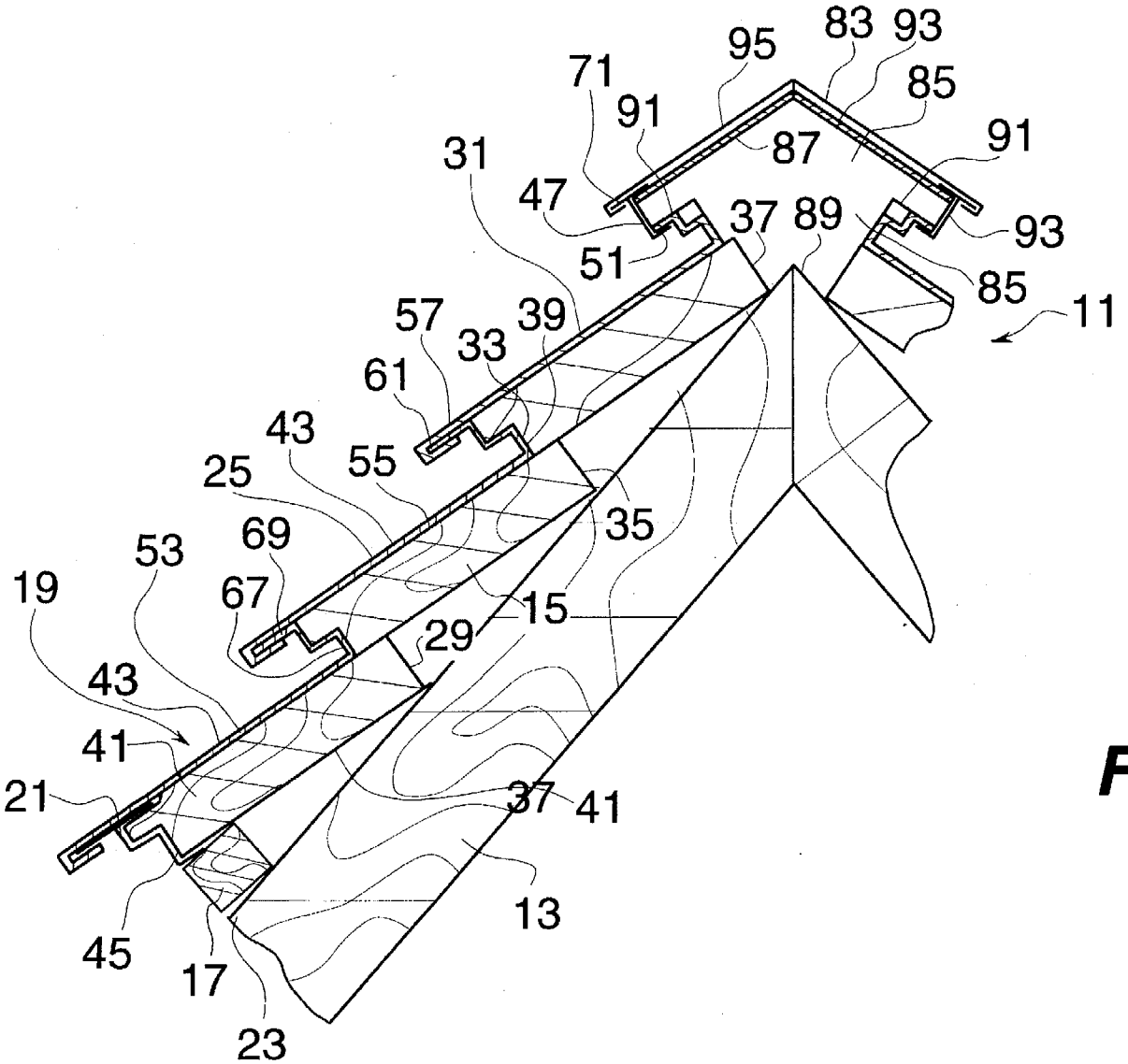
FIG. 1 is a side elevation of a sloping roof showing the base members mounted on the rafters of a structure with interlocking roof panels in accordance with invention mounted on the base members and with a cap in place at the peak.
Figure 5:
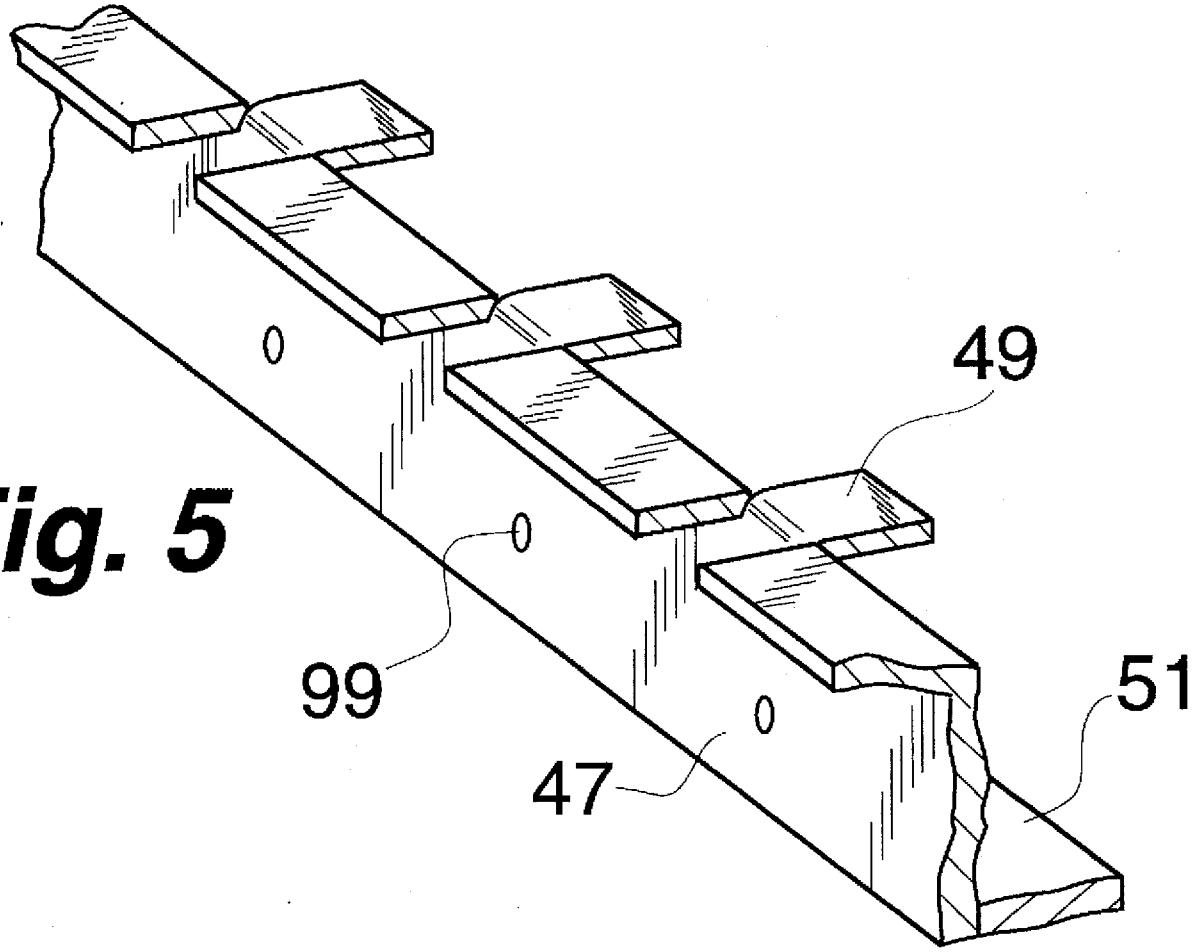

FIG. 5 is a perspective view of a Z-shaped member with tabs cut out to secure the Z-shaped member both to the lowest edge of the roof and to the cap as shown in FIG. 1.

DETAILED DESCRIPTION OF THE PREFERRED EMBODIMENT

Referring now to FIG. 1, a peaked sloping roof 11 with rafters 13 utilizing the invention is shown. A series of base members 15 are mounted on the rafters 13. A riser 17 is used to elevate the base member 15 of the first tier 19. The base members 15 may be made from a wide variety of materials including solid wood, plywood strips or even fiberglass. Starting with the base member 15 of the first tier 19, the base members 15 are mounted, as previously stated on the rafters 13, but with the lower edge 21 of the first base member 15 elevated off the rafters 13 by the riser 17. The riser 17 is secured rigidly to the rafters 13 by nailing or other equivalent fasteners. The riser 17 is secured to the rafters 13 at the lowest point or the bottom edge 23 of the rafters 13. The base member 15 of the first tier 19 extends from the riser 17 back to the rafters 13 and both the riser 17 and the base member 15 are secured to the rafters 13 by any suitable means such as nailing. The riser 17 causes the base member 15 of the first tier 19 to be located at an acute angle with the horizontal less than the acute angle to the horizontal of the rafters 13 which is substantially the same angle of all the base members 15.

The next successive base member 15 which is the base member 15 of the second tier 25 is placed with its lowest edge 27 overlapping the upper edge 29 of the base member 15 of the first tier 19. Similarly, the base member 15 of the third tier 31 is mounted with its lower edge 33 overlapping the upper edge 35 of the base member 15 of the second tier 25. The base members 15 of the first tier 19 and the second tier 25 rest at their upper edges 29 on the rafters 13 as does the upper edge of the third tier 31.

Each of the base members 15 has an indentation or notch 39 along its lower edge 21,27,33. The notch 39 is preferably generally square and is approximately half the thickness of the base member 15 in height and, with a similarly depth. Each base member 15 has a bottom surface 41 which is against the rafters 13 and a top surface 43 which is opposite from the bottom surface 41. The upper edge 29, 35, 37 of each base member 15 is opposite from the lower edge 21, 27, 33 and always rests on the rafters 13. The notch 39 extends along the lower edge 21, 27, 33 of each base member 15 from the bottom surface 41 half way up to the top surface 43.

The first tier 19 has particular added features in addition to the riser 17. At the lower edge 21 of the base member 15 of the first tier 19, an L-shaped member 45 is first used to cover the notch 39 and fit under the lower surface of the first base member 15 between the bottom surface 41 of the base member 15 of the first tier 19 and the riser 17. Then a tab member 47 which is generally Z-shaped is shown in FIG. 5 is mounted on the lower edge 21 of the base member 15. The tab member 47 has tabs 49 cut out and bent over approximately one-hundred eighty degrees. The tabs 49 are secured to the base member 15 of the first tier 19 at the surface 43 and the lower lip 51 of the tab member 47 overlaps the L-shaped member 45.

Each of the panels 53 which are mounted on the base members 15 also has a bottom surface 55 which rests upon a base member 15 and a top surface 57 which is opposite from the bottom surface 55. Each panel 53 also has a lower edge 59 which is adjacent the lower edge 21, 27, 33 of the respective base member 15 on which the panel 53 is mounted. Opposite from the lower edge 59 of each panel 53 is an upper edge 61 which interlocks with the lower edge 59 of the next successive panel 53 and also is secured to the notch 39 of the next successive base member 15. Each panel 53 also has two side edges 63. Between the lower edge 59 and upper edge 61 and the two side edges 63 of each panel 53 is a flat area 65.

The lower edge 59 of each panel 53 is bent back around under the bottom surface 55 of the panel 53 forming a groove 56. At the upper edge 61, the panel 53 turns upwardly at approximately right angles to the flat area 65 and then turns back over the flat area 65 to form generally a protrusion 67 to fit into the notch 39 in the edge 59 of the base member 15 of the next successive tier 25, 31. The upper edge 61 of the panel 53 then bends upwardly at approximately right angles to the flat area 65 and the once again bends at approximately a right angle over the flat area 65 and generally parallel to the flat area 65 to form a lip 69. The lip 69 is secured in the groove 56 of the next adjacent higher panel 53.

At the first tier 19, since there is no lip 69 from a lower panel 53, the groove 56 of the panel 53 of the first tier 19 mounts on the partial lip 71 of the tab member 47. Each successively higher panel 53 thereafter has the groove 56 along its lower edge 59 secured into the groove 56 of the successively lower panel 53.

At each side edge 63, there is a side member 73 which extends upwardly approximately at right angles to the flat area 65. A side lip 75 extends at right angles from the side member 73 over the flat surface 65. When panels 53 are joined together in the same tier, a clip joiner 77, as shown in FIG. **4*b* is used which includes two grooves 79 which are bent over two side lips 75 which are back to back. As best seen in FIG. 4*a*, the clip joiners 77** are preferably placed one above each other in alternating tiers.

At the peak 81 of the roof 11 a cap 83 is used to seal the peak 81. Returning to FIG. 1, the cap 83 is shown at the peak 81 of the roof 11. At each rafter 13, a cap segment 85 is formed to fit over the upper edges of the most upper panels on both sides of the peaked roof and onto the rafters 13 between the two most upper panels 53. The cap segment 85 has upper abutting top edges 87 which slope generally at the same angle as the respective panels 53 over which each such top edge 87 is located. At a lower edge 89 of the cap segments 85, each cap segment 85 has a cap notch 91 similar to the notch 39 in the base members 15. The cap segments 85 are securely fastened to the rafters 13 and the base members 15 but are not nailed into the panels 53 to avoid puncturing the panels 53. The cap notch 91 is located in the lower edge 89 of each cap segment 85 and extends a part of the length of the cap segment 85 over the base member 15. The panels 53 of the most upper tiers 31 are forced into the cap notch 91 so that the edge of the lip 69 is at the edge of the cap notch 91. Cap members 93 are secured to the cap segments 85 to form a base for a cap cover 95. At both lower edges 97 of the cap members 93, generally the same tab members 47 as used at the lower edge 21 of the base member 15 of the first tier 19 and as shown in FIG. 5 are used. However, at the cap 83, the tab member 47 may, if desired, have openings 99 to provide ventilation. The lower lip 51 of the tab member 47 engages the lip 69 of the most upper panel 53 securing the panel 53 in place. The same partial lip 71 of the tab member 47 is thus formed and a cap cover 95 is secured around the partial lips 71 to hold the cap cover 95 on the cap members 93 without any exposed fasteners.

Thus, while a preferred embodiment of the invention has been shown and described, it will be apparent to those skilled in the art that many other changes and modifications may be made without departing from the invention in its broader aspects. The appended claims are therefore intended to cover all such changes and modifications as fall within the true spirit and scope of the invention.

I claim:

1. An interlocking roof system having a multiplicity of interlocking panels for use on a structure with sloping rafters, said interlocking roof system comprising:

rafters which slope downwardly from a peak to a lower edge;

a riser secured to the lower edge of the rafters;

multiple tiers of base members mounted horizontally on the rafters, a first tier including a base member with a lower edge mounted on the riser and an upper edge mounted on the rafters, a second tier including a base member with a lower edge mounted on the base member of the first tier and an upper edge mounted on the rafters and successive tiers each including a lower edge on the base member of the successively lower tier and an upper edge on the rafters, each base member having a notch in its lower edge;

panels, each having an upper edge and a lower edge, being mounted on the base members of the tiers, each panel having a groove at its lower edge and a protrusion and a lip at its upper edge, each panel having a side member and a side lip, the protrusion of each panel being secured within the notch of the base member of the next successive higher tier;

a tab member having a general Z-shape mounted on the lower edge of the base member of the first tier forming a partial lip, the groove of each panel of the first tier being mounted on the partial lip and the groove of each panel of each successive tier being mounted on the lip of the next succeeding lower tier;

a clip joiner for mounting on the side lip of two adjoining panels in the same tier;

a cap mounted at the peak of the rafters, the cap including cap segments with a lower edge affixed to the rafters and extending over the base member of the tiers most adjacent the cap and having indentations at the lower edge, the upper edges of the panels being secured in the indentation, cap members mounted on the cap segments on each side of the peak, each cap member having a slope generally the same as the slope of the panels on the side of the peak where the cap member is located and each cap member having a lower edge, a cap cover located over the cap members and a pair of tab members secured to the lower edge of cap members to secure the cap cover.

2. An interlocking roof system having a multiplicity of interlocking panels for use on a structure with sloping rafters, said interlocking roof system comprising:

rafters which slope downwardly from a peak to a lower edge;

multiple tiers of successively higher and lower base members, each having a lower edge and an upper edge and a notch in its upper edge, the upper edges of the base members resting on the rafters and the lower edge resting on the upper edge of the base members of the adjacent lower tier; and panels, each having an upper edge and a lower edge being mounted on the base members of the tiers, each panel having a groove at its lower edge and a protrusion and a lip at its upper edge, the protrusion of each panel being secured within the notch of the base member of the next successive higher tier.

3. An interlocking roof system according to claim 2 and further including a cap mounted at the peak of the rafters.

4. An interlocking roof system according to claim 2 wherein each panel further includes a side member and a side lip.

5. An interlocking roof system according to claim 2 wherein each panel further includes a side panel and a side lip and a clip joiner for mounting on the side lip of two adjoining panels in the same tier.

6. An interlocking roof system according to claim 2 and further including a cap mounted at the peak of the rafters, the cap including cap segments with a lower edge affixed to the rafters and extending over the base member of the tiers most adjacent the cap and having indentations at the lower edge, the upper edges of the panels being secured in the indentation, cap members mounted on the cap segments on each side of the peak, each cap member having a slope generally the same as the slope of the panels on the side of the peak where the cap member is located and each cap member having a lower edge, a cap cover located over the cap members and a pair of tabs members secured to the lower edge of the cap members to secure the cap cover.

* * * * *